US005568744A

United States Patent [19]

Grotepass

[11] Patent Number: 5,568,744

[45] Date of Patent: Oct. 29, 1996

[54] METHOD AND ARRANGEMENT FOR MANUFACTURING ROLLED WIRE OR ROUND STEEL SECTIONS IN COILS FROM CARBON STEELS AND/OR HIGH-GRADE STEELS

[75] Inventor: Johann Grotepass, Ratingen, Germany

[73] Assignee: SMS Schloemann-Siemag AG, Düsseldorf, Germany

[21] Appl. No.: 853,793

[22] Filed: Mar. 19, 1992

[30] Foreign Application Priority Data

Mar. 19, 1991 [DE] Germany ..... 41 08 941.3

[51] Int. Cl.[6] ..... B21B 1/16

[52] U.S. Cl. ..... 72/201; 72/228; 72/251; 140/2

[58] Field of Search ..... 72/201, 221, 228, 72/231, 234, 239, 251; 140/1, 2; 266/106

[56] References Cited

U.S. PATENT DOCUMENTS

| | | | |
|---|---|---|---|
| 1,910,889 | 5/1933 | Fisk | 72/228 |
| 3,383,896 | 5/1968 | Blinn | 72/228 |
| 4,056,186 | 11/1977 | Hill | 266/106 |
| 4,320,646 | 3/1982 | Bindernagel et al. | 266/106 |
| 4,363,394 | 12/1982 | Kirchhoff | 72/419 |
| 4,546,957 | 10/1985 | Jalil et al. | 266/106 |
| 4,807,457 | 2/1989 | Polino et al. | 72/201 |
| 4,871,146 | 10/1989 | Yamada et al. | 266/106 |
| 4,982,935 | 1/1991 | Nonini et al. | 72/201 |

FOREIGN PATENT DOCUMENTS

| | | | |
|---|---|---|---|
| 0255236 | 3/1988 | Germany | 72/235 |

*Primary Examiner*—Lowell A. Larson
*Assistant Examiner*—Thomas C. Schoeffler
*Attorney, Agent, or Firm*—Anderson Kill Olick & Oshinsky, P.C.

[57] ABSTRACT

A method and an arrangement for manufacturing rolled wire sections and round steel sections in coils from carbon steels or high-grade steels. The arrangement includes a wire production line with a multiple-stand wire mill and a round steel production line with, for example, a multiple-stand round steel mill which branches from a common billet supply line including a billet furnace and a cooling bed, wherein the wire mill and the round steel mill are arranged next to each other. An aftertreatment unit following the production lines includes a coil forming station for round steel sections and for wire sections arranged following one of the two production lines, a transfer device for wire coils to the round steel production line, a coil forming device for wire sections arranged at the end of the wire mill, the coil forming device being followed by a transfer device for wire coils or round steel coils, and a coil conveying and cooling device arranged following one of the two production lines.

12 Claims, 1 Drawing Sheet

METHOD AND ARRANGEMENT FOR MANUFACTURING ROLLED WIRE OR ROUND STEEL SECTIONS IN COILS FROM CARBON STEELS AND/OR HIGH-GRADE STEELS

BACKGROUND OF THE INVENTION

1. Field of the Invention

The present invention relates to a method and an arrangement for manufacturing rolled wire or round steel sections in coils from carbon steels or high-grade steels. In the method and arrangement, billets are used as the initial material. The billets are removed at rolling temperature from a billet furnace and, in successive steps of operation, are rolled in a multiple-stand rolling mill train into wire sections or round steel sections, hexagonal steel sections or square steel sections and, in a sequence of aftertreatment steps, the wire sections or round steel sections are wound into coils, are cooled and transferred to a coil conveyor, wherein these aftertreatment steps are carried out in accordance with material quality and/or predetermined end product quality in different stations, and particularly with different temperature gradients.

2. Description of the Related Art

The above-described method and arrangement are used particularly in the manufacture of different steel qualities, preferably of alloy qualities-for example, high-grade steels. The steels are cooled as required slowly, with a delay, or quickly. The method and the arrangement are particularly suitable for the production of wire products having diameters of 5 to 20 mm and for round steel dimensions of 10 to 60 mm.

The following methods of aftertreatment in a wire production line are known in the art:

a) Cooling with air, for example, Stelmor method;

b) delayed cooling without air, for example, Stelmor method with insulation chambers;

c) slow cooling, for example, in insulation hoods or insulation chambers which are also heatable;

d) quick cooling, for example, in a water bath.

Round steel production lines in coils conventionally include the following aftertreatment methods:

e) quick cooling, for example, in a water Garrett reel;

f) delayed cooling, for example, in a Garrett reel with subsequent transport through an insulation chamber;

g) slow cooling, for example, in a Garrett reel with subsequent transport through an insulation chamber which is also heatable, or with insulation hoods being placed over the coils, to storage locations.

In the past, each production line for wire or round steel was followed by a separate aftertreatment plant. In the manufacture of wire and round steel sections with frequently changing steel qualities, for example, carbon steels and/or high-grade steels with different quality features and, thus, different thermal aftertreatments or final treatments (particularly in comparatively small batches, such an arrangement of the production lines with substantial separate aftertreatment units results in relatively high investment and operation costs). As a result, the price of the products is increased in an uneconomical manner.

SUMMARY OF THE INVENTION

Therefore, it is the object of the present invention to provide a method and a corresponding arrangement for the manufacture of rolled wire or round steel sections in coils in which the costs for the thermal aftertreatment of the different rolled products is drastically lowered in order to facilitate an economical production of very different steel qualities with frequently changing aftertreatment and in comparatively small individual batches.

In accordance with the present invention in a method described above, a wire production line is used for rolling the wire sections and a round steel production line, located adjacent the wire production line, is used for rolling the round steel sections. For each of the different aftertreatment steps of the rolled products of both production lines, a common aftertreatment unit is provided for both production lines with different aftertreatment stations. Each rolled product of the one or the other production line is conveyed by conveying means depending on the predetermined specific aftertreatment to one aftertreatment station or successively to several different aftertreatment stations.

Since rolling of the wire sections and of the round steel sections is carried out in production lines which are arranged next to each other, and both production lines are followed by a common aftertreatment unit with different stations, and since each rolled product of one of the two production lines travels in accordance with its predetermined special aftertreatment through one aftertreatment station or successively through several different aftertreatment stations, the present invention provides the advantage that the combination of corresponding aftertreatment steps in different rolled products is achieved in a particularly flexible and economical manner. The resulting improvement in productivity and flexibility also makes it possible to produce economically smaller numbers of individual batches with different steel qualities.

In accordance with the present invention, the arrangement for carrying out the method includes:

a) a wire production line with a multiple-stand wire mill and a round steel production line with, for example, a multiple-stand round steel mill which branches from a common billet supply line including a billet furnace and a cooling bed, wherein the wire mill and the round steel mill are arranged next to each other;

b) an aftertreatment unit following the production lines including:

- a coil forming station for round steel sections as well as for wire sections arranged following one of the two production lines;
- a transfer device for wire coils to the round steel production line;
- a coil forming device for wire sections arranged at the end of a Stelmor line, the coil forming device being followed by a transfer device for wire coils or round steel coils;
- a coil conveying and cooling device arranged following one of the two production lines.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DESCRIPTION OF THE PREFERRED EMBODIMENT

Figure 1:
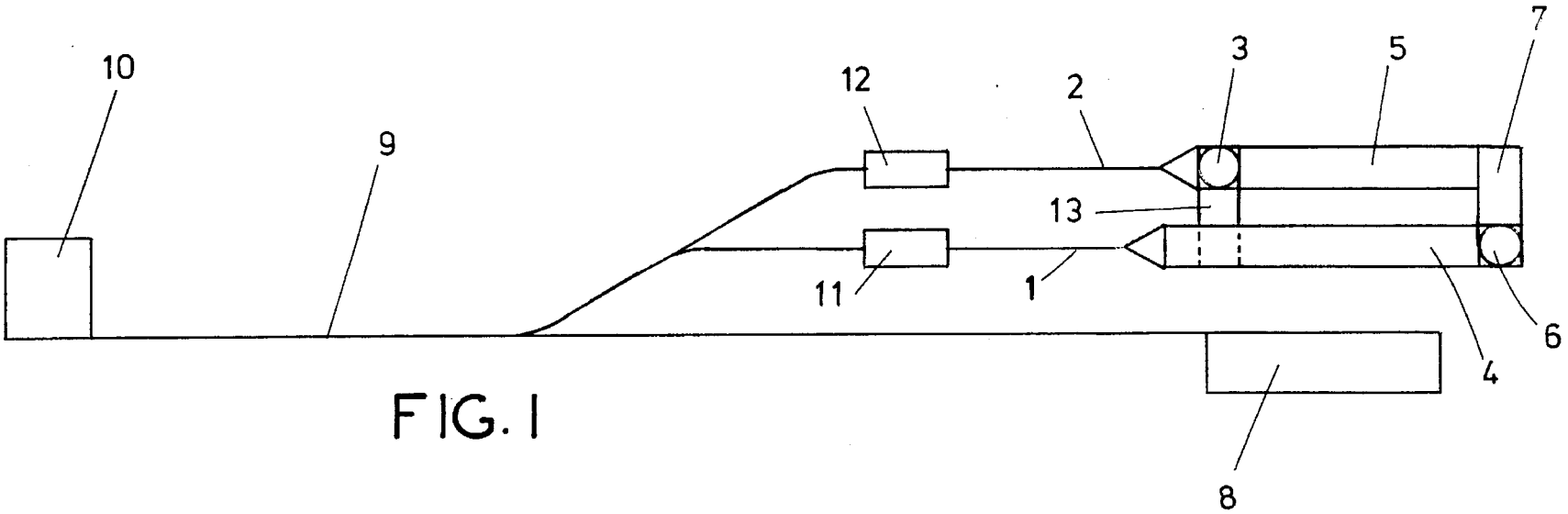
FIG. 1 is a schematic illustration of the arrangement according to the present invention.

The arrangement illustrated in the figure of the drawing includes a billet furnace 10 with a billet supply line 9. The billet supply line 9 ends in a cooling bed 8. Branching off from the billet supply line 9 are a wire production line 1 and a round steel production line 2. A multiple-stand wire mill or wire finishing mill 11 is arranged in the wire production line 1 and a possibly multiple-stand round steel mill 12 is arranged in the round steel production line 2. The wire mill 11 is associated, for example, with a Stelmor line 4 with or without cooling air device. At the end of the Stelmor line 4 is provided a coil forming device 6 for wire sections. The round steel production line 2 or round steel mill 12 is followed by a coil forming device 3 for both round steel sections and for wire sections, which both are to be cooled slowly on a coil conveyor 5.

The coil forming device 3 and the Stelmor line 4 are operationally connected to each other through a transverse conveying device 13 at the entry side thereof and possibly additionally by a transfer device 7 for wire coils and round steel coils at the end thereof. The transverse conveying devices or coil transfer devices 7, 13 provide the advantage that only one coil forming device necessary for both round steel sections and for wire sections for the different types of material and different types of cooling and for the appropriate stations for rapid or slow cooling. The coil forming station 3 for round steel sections can also be used for wire sections which must be cooled slowly, and vice versa. On the other hand, round steel and wire which is to be cooled quickly can be subjected to aftertreatment in a coil forming station which is equipped with Garrett reel and water bath. Furthermore, the arrangement requires only one coil conveyor for wire or round steel for slow cooling; for example, in a Garrett reel with subsequent conveyance through an insulation chamber or with insulating hoods placed thereon to one or more common storage locations.

Figure 2:
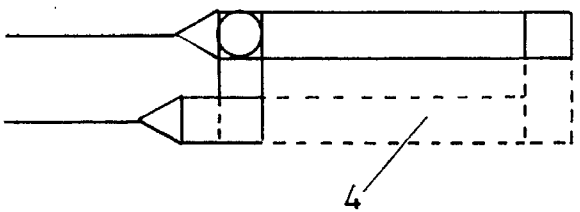
FIG. 2 is a partial illustration of the invention expanded beyond the illustrated basic equipment by providing a Stelmor line for cooling.

The arrangement for manufacturing rolled wire or round steel sections in coils can be expanded beyond the illustrated basic equipment with simple means in accordance with the partial illustration of FIG. 2, for example, by later providing a Stelmor line 4 for delayed cooling within insulation chambers or for slow cooling by means of insulation hoods, which may also be heatable. An additional Garrett reel, for example, with a water spraying device, may be provided for rapid cooling and a water bath or also a water Garrett reel may be provided for sudden quenching. The advantage provided by the present invention is that each of these different aftertreatment devices is available for both production lines and can be reached or transported for each different rolled product by transverse transfer devices means 7, 13 between the after treatement stations. As a result, the arrangement of the present invention provides a high degree of flexibility for economical production of different rolled material dimensions of steel qualities while requiring very few production and aftertreatment stations.

While a specific embodiment of the invention has been shown and described in detail to illustrate the application of the inventive principles, it will be understood that the invention may be embodied otherwise without departing from such principles.

I claim:

1. An arrangement for manufacturing rolled wire sections and round steel sections in coils from carbon steels of high-grade steels, comprising:

a common billet supply line including a billet furnace;

a wire production line including a wire mill and branching from said common billet line;

a round steel production line including a round steel mill and branching from said common billet production line, said round steel production line being arranged adjacent to said wire steel production line; and an aftertreatment unit common for said wire production line and said round steel production line, said after-treatment station comprising:

a coil transporting and slow cooling device, arranged downstream of the round steel production line;

a first coil forming device located upstream of said coil transporting and cooling device and adapted to form both round steel coils and wire steel coils;

a first transfer device for connecting said first coil forming device with said wire section production line;

a Stelmor line arranged downstream of said wire section production line;

a second coil forming device located at an end of said Stelmor line remote from said wire section production line for forming wire section coils; and a second transfer device for connecting said second coil forming device with said coil transporting and cooling device.

2. The arrangement of claim 1, wherein said after-treatment unit comprises one of an insulation chamber and an insulation overhead hood for slowly cooling the coils.

3. The arrangement of claim 2, further comprising means for heating said one of an insulation chamber and an insulation overhead hood.

4. The arrangement of claim 1, wherein said second coil forming device comprises a Garret reel with a water bath for quick cooling of the coils.

5. A method of manufacturing at least one of wire sections and round steel sections in coils from carbon or high-grade steels, said method comprising the steps:

providing a wire production line and a round steel production line, arranged adjacent to each other;

providing an aftertreatment unit common for the wire and the round steel production lines and including first and second aftertreatment stations for cooling the wire sections and the round steel sections with a different temperature gradient and connected with the wire production line and the round steel production line respectively, a first transfer device connecting the wire and round steel production lines and located upstream of the first and second aftertreatment stations, and a first coil forming device arranged upstream of the second aftertreatment station and connected with the wire production line by the first transfer device;

removing billets, used as initial materials from a billet furnace;

rolling the billets in successive operational steps into the at least one of the wire sections and the round steel sections in a respective one of the wire production line and the round steel production line; and thereafter, transporting the rolled at least one of the wire sections and the round steel sections to one of the two aftertreatment stations in accordance with an initial material quality and a predetermined end product quality for appropriate treatment therein.

6. The method of claim 5, wherein the step of providing the aftertreatment unit comprises providing an aftertreatment unit in which the first aftertreatment station is a Stelmor line and the second aftertreatment station is a coil transporting and slowly cooling device; and wherein the transporting step includes coiling of the at least one of the wire sections and the round steel sections before transporting the at least one of the wire sections and the round steel sections into the coil transporting and cooling device.

7. The method of claim 6, further comprising the step of providing the Stelmor line with cooling air means for accelerated cooling of the rolled sections.

8. The method of claim 6, wherein the step of providing the aftertreatment station includes providing an aftertreatment station, further including one of an insulation chamber and an overhead insulated hood, and wherein the method further includes conveying coils of the at least one of the round steel sections and the wire sections formed by the first coil forming device through the one of the insulation chamber and the overhead insulated hood.

9. The method of claim 8, further comprising the step of heating one of the insulation chamber and the overhead insulation hood.

10. The method of claim 6, wherein the step of providing the aftertreatment station includes providing the aftertreatment station including a second coil forming device arranged at an end of the Stelmor line remote from the wire section production line, and a second transfer device connecting the second coil forming device with the coil transporting and the slowly cooling device.

11. The method of claim 10, wherein the step of providing the aftertreatment station includes providing an aftertreatment station in which at least one of the first and second coiling devices is formed as a Garret reel.

12. The method of claim 11, further comprising the step of providing the Garret reel with a water bath for rapid cooling of the rolled section.

* * * * *